US006619374B1

(12) United States Patent
Morishita et al.

(10) Patent No.: US 6,619,374 B1
(45) Date of Patent: Sep. 16, 2003

(54) APPARATUS FOR SEPARATING CASTING STRAINERS

(75) Inventors: Toshiharu Morishita, Shizuoka-ken (JP); Shigeru Tanaka, Shizuoka-ken (JP)

(73) Assignee: Asaki Tec. Corporation, Shizuoka (JP)

( * ) Notice: Subject to any disclaimer, the term of this patent is extended or adjusted under 35 U.S.C. 154(b) by 0 days.

(21) Appl. No.: 09/585,832

(22) Filed: Jun. 1, 2000

(51) Int. Cl.[7] ..... B22D 45/00; B22C 9/08

(52) U.S. Cl. ..... 164/412; 164/358

(58) Field of Search ..... 164/339, 341, 164/344, 358, 362, 412, 134; 222/189.06, 189.07, 189.08; 210/323.1, 323.2; 266/227

(56) References Cited

U.S. PATENT DOCUMENTS

| | | | | | |
|---|---|---|---|---|---|
| 4,154,289 | A | * | 5/1979 | Jeanneret | 164/358 |
| 4,362,616 | A | * | 12/1982 | Gehrmann et al. | 210/225 |
| RE31,972 | E | * | 8/1985 | Nieman et al. | 164/362 |
| 4,576,219 | A | * | 3/1986 | Uram | 164/358 |
| 4,749,022 | A | * | 6/1988 | Jeanneret | 164/358 |
| 5,556,592 | A | * | 9/1996 | Hitchings | 266/227 |
| 6,231,639 | B1 | * | 5/2001 | Eichenmiller et al. | 75/407 |

FOREIGN PATENT DOCUMENTS

| | | | | |
|---|---|---|---|---|
| GB | 2303080 | * | 2/1997 | B01D/25/12 |
| JP | 56-70808 | * | 6/1981 | B01D/25/12 |
| JP | 10-193435 | * | 7/1998 | B29C/47/68 |
| WO | WO 99/15290 | * | 4/1999 | B22C/9/08 |

* cited by examiner

*Primary Examiner*—Kuang Y. Lin
*Assistant Examiner*—Kevin P. Kerns
(74) *Attorney, Agent, or Firm*—Muramatsu & Associates

(57) ABSTRACT

An apparatus for separating casting strainers and transferring each separated casting strainer to a predetermined position. The apparatus includes a casting strainer receiving member in which a plurality of casting strainers are stacked up, a slide member for horizontally sliding under the casting strainer receiving member, a separator projecting from the slide member towards the casting strainers, a casting strainer stopper formed at the lower end or vicinity of the casting strainer receiving member, a casting strainer passage formed in the slide member at an area immediately under a projecting end of the separator for receiving the separated casting strainer, and a shooter formed under the slide member for transferring the casting strainer to the predetermined position.

16 Claims, 8 Drawing Sheets

APPARATUS FOR SEPARATING CASTING STRAINERS

FIELD OF THE INVENTION

This invention relates to an apparatus for separating casting strainers and transferring the casting strainers to a predetermined position.

RELATED ART

Conventionally, in order to separate and drop casting strainers, casting strainers are affixed by an adhesive tape, then taken out of a casting strainer magazine and then delivered to a destination for attachment.

However, the above-mentioned conventional attaching method has such a shortcoming that dusts or the like are readily deposited on an adhesive surface of the adhesive tape thus lessening its adhesive force and therefore, much time and labor is required to properly attach the casting strainers to a setting-up place.

SUMMARY OF THE INVENTION

It is, therefore, an object of the present invention to provide, in order to obviate the above-mentioned shortcoming, an apparatus for separating and dropping casting strainers which is easy to manage when the casting strainers are properly attached to a setting-up place.

In order to achieve the above object, there is essentially provided an apparatus for separating casting strainers comprising a slide member on which casting strainers are stacked up in superimposed relation, drive means for sliding the casting strainers and the slide member relative to each other, a separator projecting from the slide member towards the casting strainers and a casting strainer passage at an area closer to the casting strainers than the separator, wherein a casting strainer stopper is disposed at least on that side of the casting strainers opposite to the separator.

A shooter adapted to receive, separate and drop the casting strainers which have passed through the casting strainer passage and a base on which the shooter is placed may be disposed under the slide member such that the shooter is reciprocally movable with respect to the base in a generally horizontal posture and the shooter is forwardly downwardly turnable through proper means when the shooter reaches a foremost end of a reciprocal stroke motion on the base.

Since the apparatus for separating casting strainers according to the present invention is constructed in the manner as described above, that side of the casting strainers opposite to the separator is stopped advancement by the casting strainer stopper when the slide member is slidingly moved towards the casting strainers. As a consequence, the separator separates the casting strainers thereby enabling advancement while allowing entry of the casting strainers into the casting strainer passage. Thus, if this apparatus for separating casting strainers is used, the casting strainers can be dropped downward, one by one, so that they are easily set up at an appropriate place.

If a shooter adapted to receive, separate and drop the casting strainers which have passed through the casting strainer passage and a base on which the shooter is placed are disposed under the slide member such that the shooter is reciprocally movable with respect to the base in a generally horizontal posture and the shooter is forwardly downwardly turnable through proper means when the shooter reaches a foremost end of a reciprocal stroke motion on the base, the casting strainers can be placed on the shooter when the shooter is moved backward. If the shooter is moved in that condition, the casting strainers can be dropped downward while sliding on the shooter, so as to be set up at the gate portion of the casting device. Accordingly, if this apparatus for separating casting strainers is used, the casting strainers can easily and properly be attached to the gate portion of the casting device. Therefore, much time and labor is not required for its management. As a consequence, working performance of the casting operation can be enhanced.

DETAILED DESCRIPTION OF THE INVENTION

One embodiment of the present invention will now be described with reference to the accompanying drawings.

Figure 1:
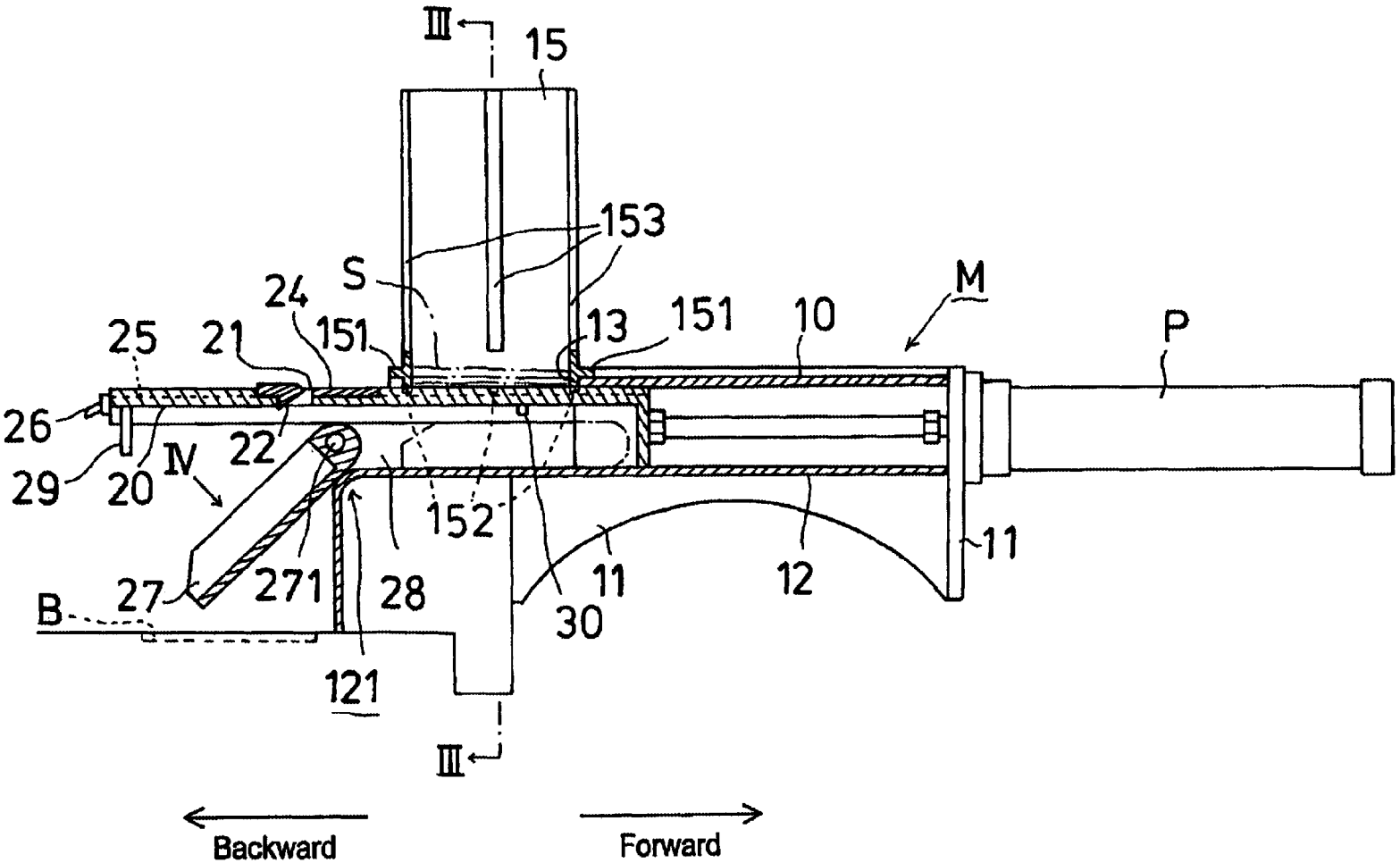
FIG. 1 is a front sectional view of an apparatus for separating casting strainers according to the present invention.
Figure 2:
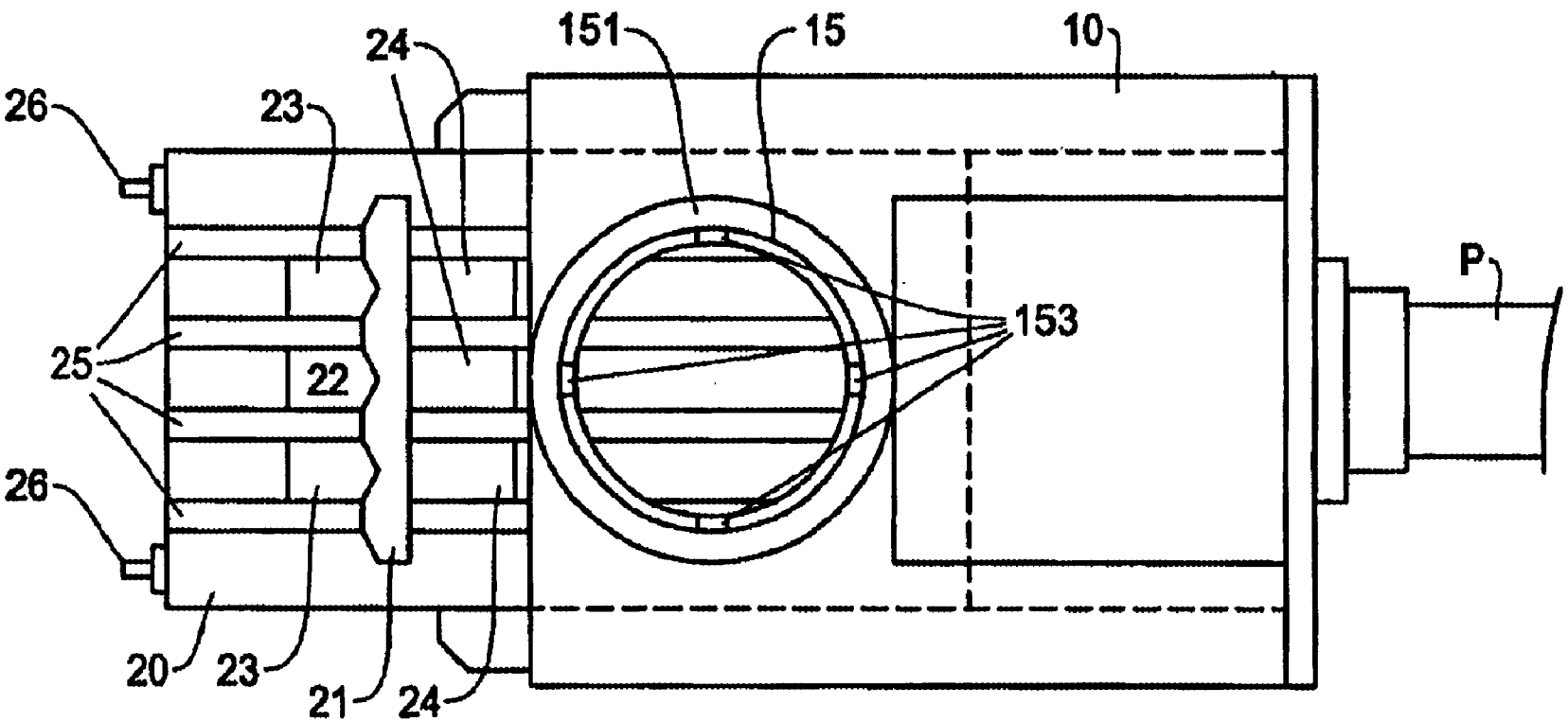
FIG. 2 is a plan view of the apparatus of FIG. 1.
Figure 3:
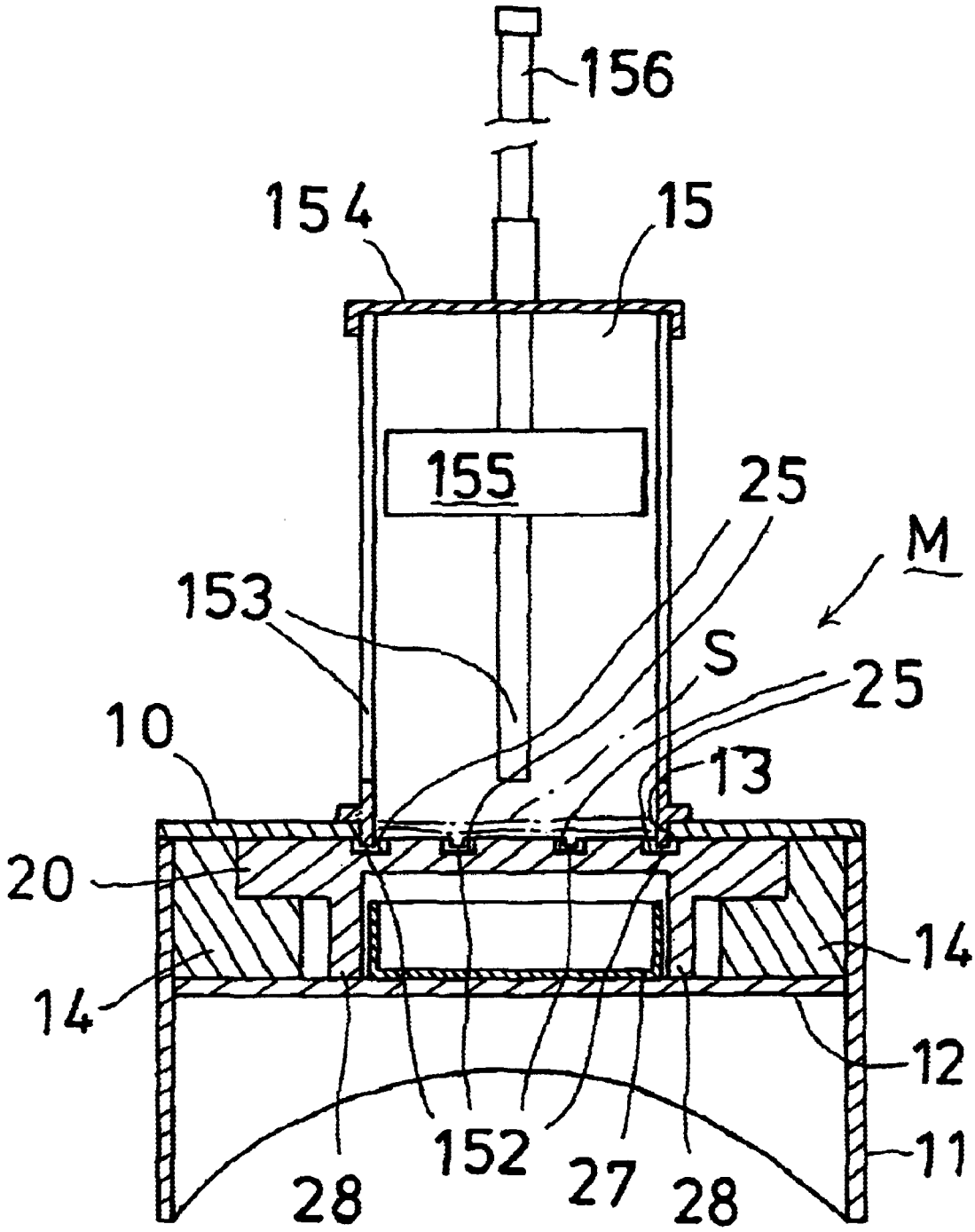
FIG. 3 is a sectional view taken on line III—III of FIG. 1.

Referring first to FIGS. 1 through 3, reference numeral 10 denotes a base of an apparatus M for separating casting strainers, and 11 denotes a tripod plate or leg plate which is fixed to the base 10. Reference numeral 12 denotes a shelf board. This shelf board 12 is mounted on the leg plate 11 under the base 10.

Reference numeral 13 denotes a complete round opening which is formed in the top of base 10. The function of this complete round opening 13 will be described later. Reference numeral 14 denotes a pair of slide support members (see FIG. 3) which are disposed between the base 10 and the shelf board 12 at opposite end edges thereof and fixed to the leg plate 11.

Reference numeral 15 denotes a casting strainer receiving sleeve (casting strainer receiving member). This casting strainer receiving member 15 is fixed to the base 10 with its lower end edge fitted to the interior of the complete round opening 13 and with its flange portion 151 engaged with a peripheral edge of the complete round opening 13. Reference numeral 152 denotes a plurality of projections which are formed on a lower end edge of the casting strainer receiving member 15. These projections 152 correspond to a casting strainer stopper of the present invention formed on that side of the casting strainer receiving member opposite to the separator. The function of the projections 152 will be described later.

Reference numeral 153 denotes a plurality of elongated holes or slots whose upper ends are open. The slots 153 are formed in a side wall of the casting strainer receiving member 15 along an axial direction thereof. Those slots 153 exhibit their functions when a casting strainer setting device A (see FIG. 6), as later described, is used. Reference numeral 154 denotes a closure member of the casting strainer receiving member 15. Reference numeral 155 denotes a casting strainer presser. This casting strainer presser 155 presses the casting strainers S in the casting strainer receiving member 15 downward or releases its pressing force with respect to the casting strainers S in accordance with a reciprocal movement of a control rod 156.

Reference numeral 20 denotes a slide plate (this slide plate corresponds to a slide member of the present invention) which is placed on the slide support members 14. This slide plate 20 is capable of making a reciprocal movement in response to the action of a piston/cylinder mechanism P which is set up on the leg plate 11, while generally contacting an undersurface of the base 10. It should be noted that instead of moving the slide plate 20, the casting strainer receiving member 15 may be moved.

Reference numeral 21 denotes a passage hole (this passage hole corresponds to a "casting strainer passage" of the present invention) for allowing passage of the casting strainers S. This passage hole 21 is formed in the slide plate 20. It is an elongated hole having a long diameter in a direction transversal to the reciprocating direction of the slide plate 20. Reference numeral 22 denotes a wedge-like separator (engagement member) formed on a rear end edge (towards between the lowermost casting strainer and a casing strainer adjacent upwardly thereto) of the casting strainer passage hole 21. The separator 22 separates, one by one, the end edges of the casting strainers S received in the casting strainer receiving member 15, when the slide plate 20 slides under the casting strainer receiving member 15, and guides them into the casting strainer passage hole 21 (see FIG. 5).

Figure 5:
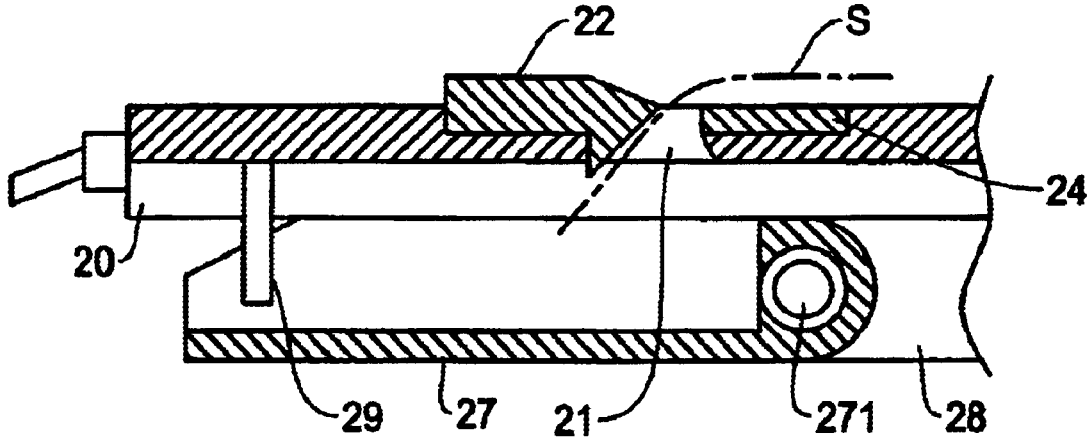
FIG. 5 is a sectional view for explaining a state in which a casting strainer is guided by a separator.

Reference numeral 23 denotes auxiliary separators provided on opposite sides of the separator 22 at a rear end edge of the casting strainer passage hole 21. Reference numeral 24 denotes casting strainer guide members which are disposed at opposing positions of the separator 22 and auxiliary separators 23 at a front end edge of the casting strainer passage hole 21. The casting strainer guide members 24 are adapted to prevent the front end edge of the casting strainer passage hole 21 from being worn caused by passage of the casting strainers S. Distal end edges of the separator 22 and auxiliary separators 23, as shown in FIG. 5, slightly project (about 1 mm) from the slide plate 20 so as to be able to separate the casting strainers S.

Since the distal ends (projecting ends) of both the separator 22 and the auxiliary separator 23 are, as shown in FIG. 2, sharpened into a V-shaped configuration (in a plan view), they can smoothly separate the casting strainers S which are in the form of a mesh. Also, since the distal ends of both the separator 22 and the auxiliary separator 23 are, as shown in FIG. 5, sharpened into a V-shaped configuration in a cross sectional view, the lowermost casting strainer S can easily be separated from all the remaining casting strainers S which are stacked up in superimposed relation. Since the surface of the casting strainer guide member 24 is flush with that of the slide plate 20, the slide plate 20 never hits the base 10 when the slide plate 20 is reciprocally slidingly moved.

Reference numeral 25 denotes slide grooves. The slide grooves 25 are formed in an upper surface of the slide plate 20 along the reciprocally moving directions thereof. The projections 152 of the casting strainer receiving member 15 are fittingly inserted in the slide grooves 25 with their distal ends held in non-contacting relation to bottom portions of the slide grooves 25. This arrangement makes it possible for the slide plate 20 to slidingly smoothly move guided by the projections 152. Further in this arrangement, the projections 152 function as a casting strainer stopper to stop the movement of the casting strainer when the separator 22 slides and contacts the casting strainer S.

Reference numeral 26 denotes nozzles of an air blow. The nozzles 26 are disposed at a rear end edge of the slide plate 20. When the slide plate 20 is moved extremely backward (i.e., when the slide plate 20 extremely approaches the gate portion B and thus a casting mold), a limit switch (not shown) is actuated to open a valve so that a compressed air is discharged from the nozzle 26 to blow off dusts, etc. which are deposited on the casting mold. In contrast, when the slide plate 20 is moved extremely forward (i.e., when the slide plate 20 is moved towards the piston/cylinder mechanism P side), another limit switch (not shown) is actuated to open the valve so that a compressed air is discharged from the nozzle 26 to blow off dusts etc. which are deposited on the slide support member 14.

Reference numeral 30 denotes a cooling air nozzle. The cooling air nozzle 30 is mounted on a front end portion of the slide plate 20. Since the cooling air nozzle 30 is set such that it is actuated by a limit switch (not shown) when the slide plate 20 moves extremely forward (i.e., when the slide-plate 20 moves towards the piston/cylinder mechanism P side), the slide plate. 20, the slide support members 14 and the shelf board 12 can be cooled when the slide plate 20 moves forward and standbys on the slide support members 14.

Reference numeral 27 denotes a shooter. This shooter 27 is turnably mounted on an undersurface of the slide plate 20 about a pin 271 through ridges 28. The shooter 27 is located underneath the casting strainer passage hole 21 and reciprocally moved together with the slide plate 20. When the shooter 27 is moved forward and placed on the shelf board 12, it is held in its horizontal posture. In contrast, when the shooter 27 is moved backward away from the shelf board 12, it is held in a slanted posture towards the gate portion B as indicated by a solid line of FIG. 1.

Since the end edge portion 121 of the shelf board 12 exhibits an arcuate configuration in section at that time, the slide plate 20 can more smoothly turn as it projects from the end edge portion 121 of the shelf board 12. As a consequence, the casting strainer S can be smoothly dropped onto a predetermined position. In this way, the shooter 27 can receive the casting strainers S in the horizontal posture (see FIG. 5) and carry them to the gate portion B in the slanted posture (see FIG. 1).

Figure 4:
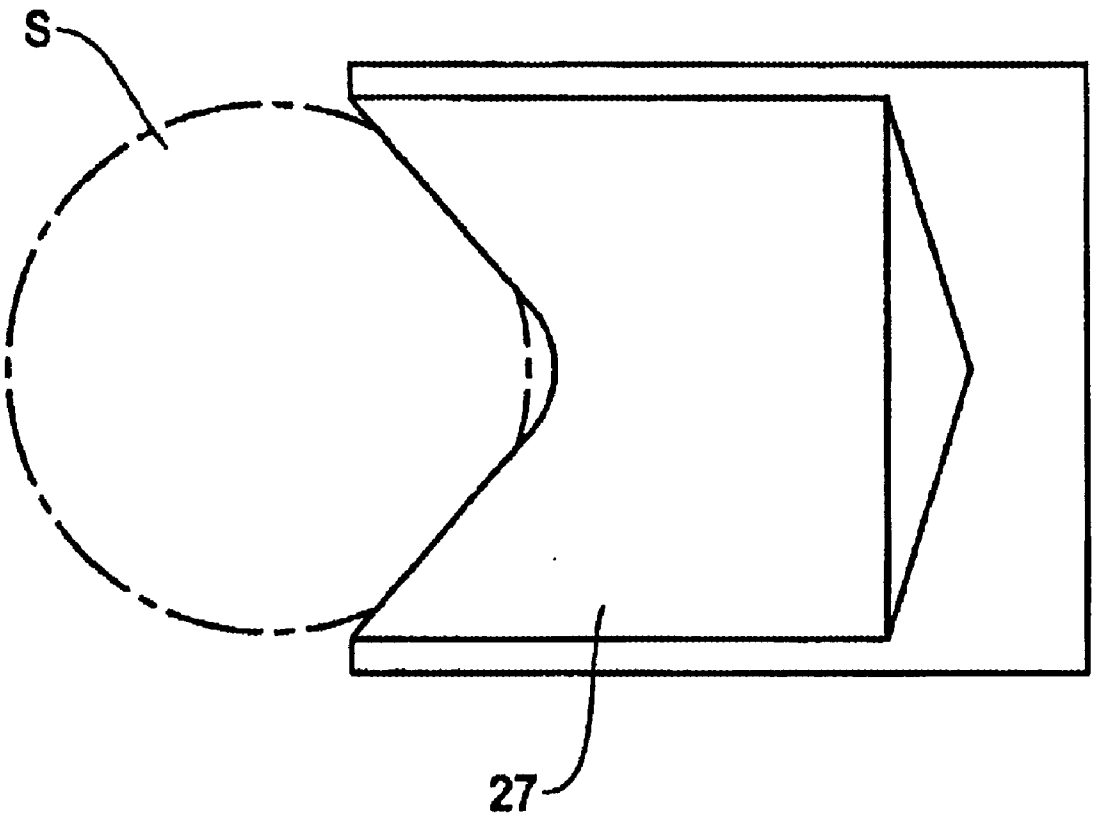
FIG. 4 is an enlarged view, when viewed in a direction indicated by an arrow IV of FIG. 1.

Since the front end edge of the shooter 27 is cut into a generally V-shaped configuration as shown in FIG. 4, the rear end portion of the disc-like casting strainer S is supported by at least two points when the casting strainer S is slippingly dropped from the shooter 27 and therefore, the casting strainer S can smoothly be dropped onto the predetermined location without lateral swinging motion (see the imaginary line of FIG. 4).

In FIG. 1, reference numeral 29 denotes a jump-out preventive member. This jump-out preventive member 29 is formed on a left end portion (in FIG. 1) of the slide plate 20 and projects downward therefrom. The jump-out preventive member 29 is adapted to prevent the casting strainer S from being slippingly dropped from the shooter 27 when the shooter 27 moves forward while receiving the casting strainer S and when the shooter 27 moves horizontally with the casting strainer S placed thereon.

Figure 6:
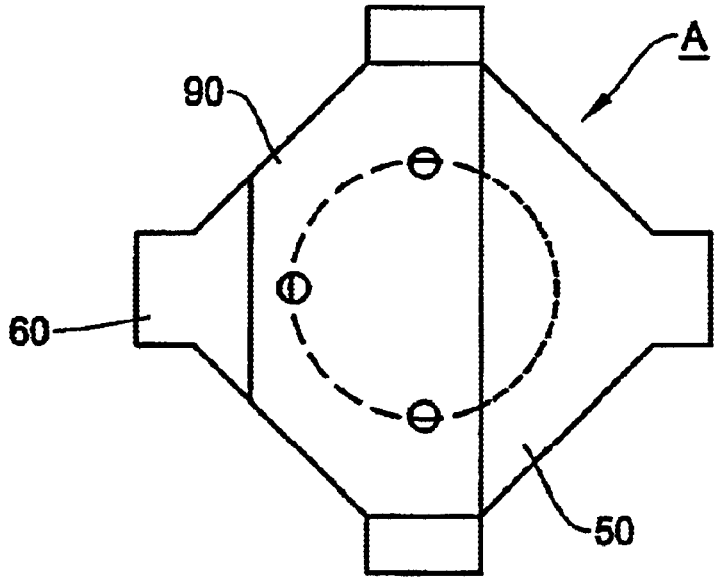
FIG. 6 is a plan view of a device for setting casting strainers.
Figure 7:
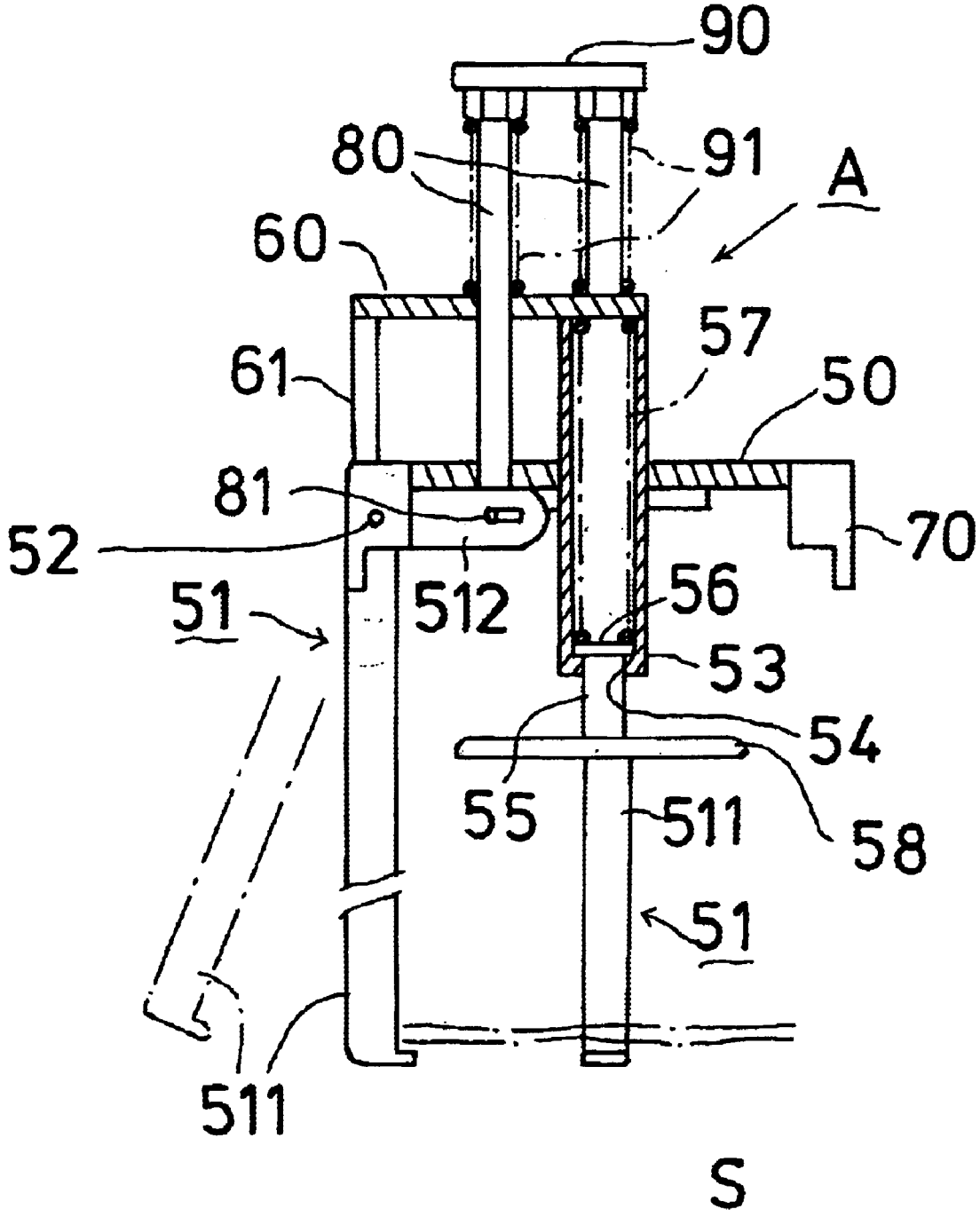
FIG. 7 is a front view of the setting device of FIG. 6.
Figure 8:
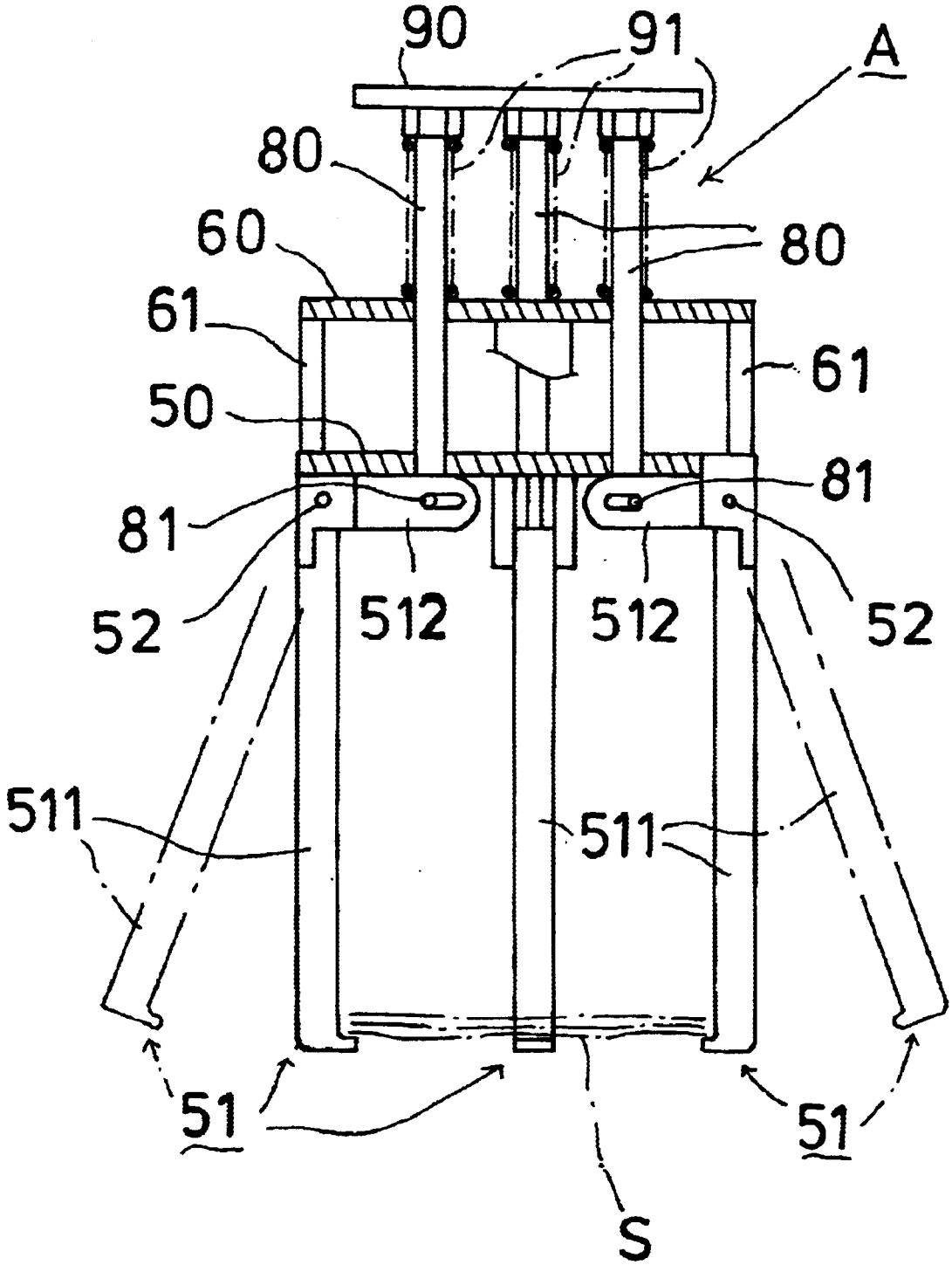
FIG. 8 is a right side view of the setting device of FIG. 6.

A casting strainer setting device A will now be described with reference to FIGS. 6 to 8.

In those Figures, reference numeral 50 denotes a base of a casting strainer setting device A. Reference numeral 51 denotes a bell crank-like clamping arm. The clamping arm 51 is turnably mounted at its angular portion on an undersurface of the base 50 through a pin 52. A long element portion 511 of the clamping arm 51 is a portion for clamping the casting strainer S and its inside diameter is set smaller by 0.2 mm or less than the outside diameter of the casting strainer S. The function of a short element portion 512 of the clamping arm 51will be described later.

Reference numeral 70 denotes an engagement piece. This engagement piece 70 is provided on an end edge portion of the undersurface of the base 50. The engagement piece 70 is brought into engagement with an upper end edge of the casting strainer receiving member 15 when the casting strainer setting device A is set to the casting strainer receiving member 15 of the casting strainers separating apparatus M.

Reference numeral 53 denotes a support sleeve having a bottom. This support sleeve 53 is fixedly inserted into a central portion of the base 50. A through hole 54 is formed in the bottom portion of the support sleeve 53. A reciprocating rod 55 is reciprocally movably fitted into the through hole 54. Reference numeral 56 denotes a spring seat. The spring seat 56 is placed on the bottom portion of the support sleeve 53 and secured to an upper end of the reciprocating rod 55. The spring seat 56 is adapted to support a compressed spring 57 which is fitted to the interior of the support sleeve 53. Reference numeral 58 denotes a presser plate. The presser plate 58 is secured to a lower end of the reciprocating rod 55. The presser plate 58 is adapted to press the clamped casting strainer S from the top.

Reference numeral 60 denotes an auxiliary plate. This auxiliary plate 60 is fixed to an upper part of the base 50 through connecting members 61. Since the auxiliary plate 60 covers an opening which is formed in an upper end of the support sleeve 53, it can press the presser plate 58 downward under the effect of the compressed spring 57.

Reference numeral 80 denotes control rods. Those control rods 80 are reciprocally movably pierced into both the base 50 and auxiliary plate 60. Lower end portions of the control rods 80 are turnably connected to the short element portion 512 of the clamping arm 51 through pins 81. Owing to this arrangement, the clamping arm 51 can be turned by reciprocally (up-down) moving the control rods 80. Thus, the long element portion 511 can be opened and closed. Reference numeral 90 denotes a control plate. This control plate 90 is fixed to upper end edges of the control rods 80. Between the control plate 90 and the auxiliary plate 60, the compressed springs 91, which are fitted onto the control rods 80, are interposed. Owing to this arrangement, by pushing the control rods 80 into the base 50 and the auxiliary plate 60 against the effect of the compressed springs 91, the clamping arm 51 can be opened. When this pushing-in operation is released, the clamping arm 51 can be closed by resiliency of the compressed springs 91.

Operation of the apparatus M for separating the casting strainers will now be described.

Firstly, a method for setting the casting strainers S to the casting strainer receiving member 15 of the apparatus M using the casting strainer setting device A is described.

A required number of casting strainers S are stacked up first. Those casting strainers S are clamped by the clamping arm 51 of the casting strainer setting device A. At that time, the presser plate 58 gently presses the upper surface of the uppermost casting strainer S.

In that state, the casting strainers S are received in the casting strainer receiving member 15 of the casting strainers separating apparatus M and the engagement piece 70 of the casting strainer setting device A is brought into engagement with the upper end edge of the casting strainer receiving member 15. When the clamping arm 51 moves to a position where it is coincident with the slot 153 formed in the casting strainer receiving member 15, the control plate 90 and thus the control rods 80 are pushed into the slot 153 against the effect of the compressed springs 91. By doing so, the control plate 90. and thus the control rods 80 can move out of the other side of the slot 153 while opening the clamping arm 51 and therefore, the clamped state of the casting strainers S can be released. Thus, the casting strainers S can be received in the casting strainer receiving member 15. Then, a closure member 154 is brought into a closed position after the casting strainers S are received in the casting strainer receiving member 15.

Thereafter, the piston/cylinder mechanism P is actuated to move the slide plate 20 forward (i.e., rightward in FIG. 1). When the slide plate 20 is brought to under the casting strainer receiving member 15, as shown in FIG. 5, that side of the casting strainer S opposite to the separator 22 is stopped its advancement by the projection 152. Therefore, the separator 22 begins to separate the lowermost casting strainer S from all the other casting strainers S received in the casting strainer receiving member 15 and guides it into the casting strainer passage hole 21 while moving forward.

The casting strainer S, which has passed through the casting strainer passage hole 21, is allowed to drop so as to be received in a shooter 27 (this shooter 27 is held in a horizontal posture). In that state, the piston/cylinder mechanism P is once stopped and then actuated again to move the slide plate 20 backward. Then, the shooter 27 is disconnected from the shelf board 12 and brought into a slanted posture, so that the casting strainer S can be carried to the gate portion B. Since the next remaining casting strainer S is brought into engagement with the projection 152 on the separator (engagement member) side when the slide plate 20 is moved backward, it never follows the movement of the slide plate 20.

In this embodiment, the projections 152 are held in non-contacting relation with the slide member (slide plate 20). Accordingly, the slide member can normally be held in a constant position with respect to the casting strainer receiving member 15. As a consequence, the casting strainer received in the casting strainer receiving member 15 and the separator are normally held constant in positional relationship. Thus, the casting strainers can easily be separated in a stable manner.

In this embodiment, the slide plate 20 is provided with the slide grooves 25 and the casting strainer receiving member 15 is provided with the projections 152 which are fittingly inserted in the slide grooves 25. Accordingly, the casting strainer receiving member 15 is restricted in position in both the reciprocating direction and the transversal direction with respect to the movement of the slide plate 20. As a consequence, the casting strainer S received in the casting strainer receiving member 15 and the separator 22 are normally held constant in positional relationship. Thus, the casting strainers S can easily be separated in a stable manner.

Figure 9:
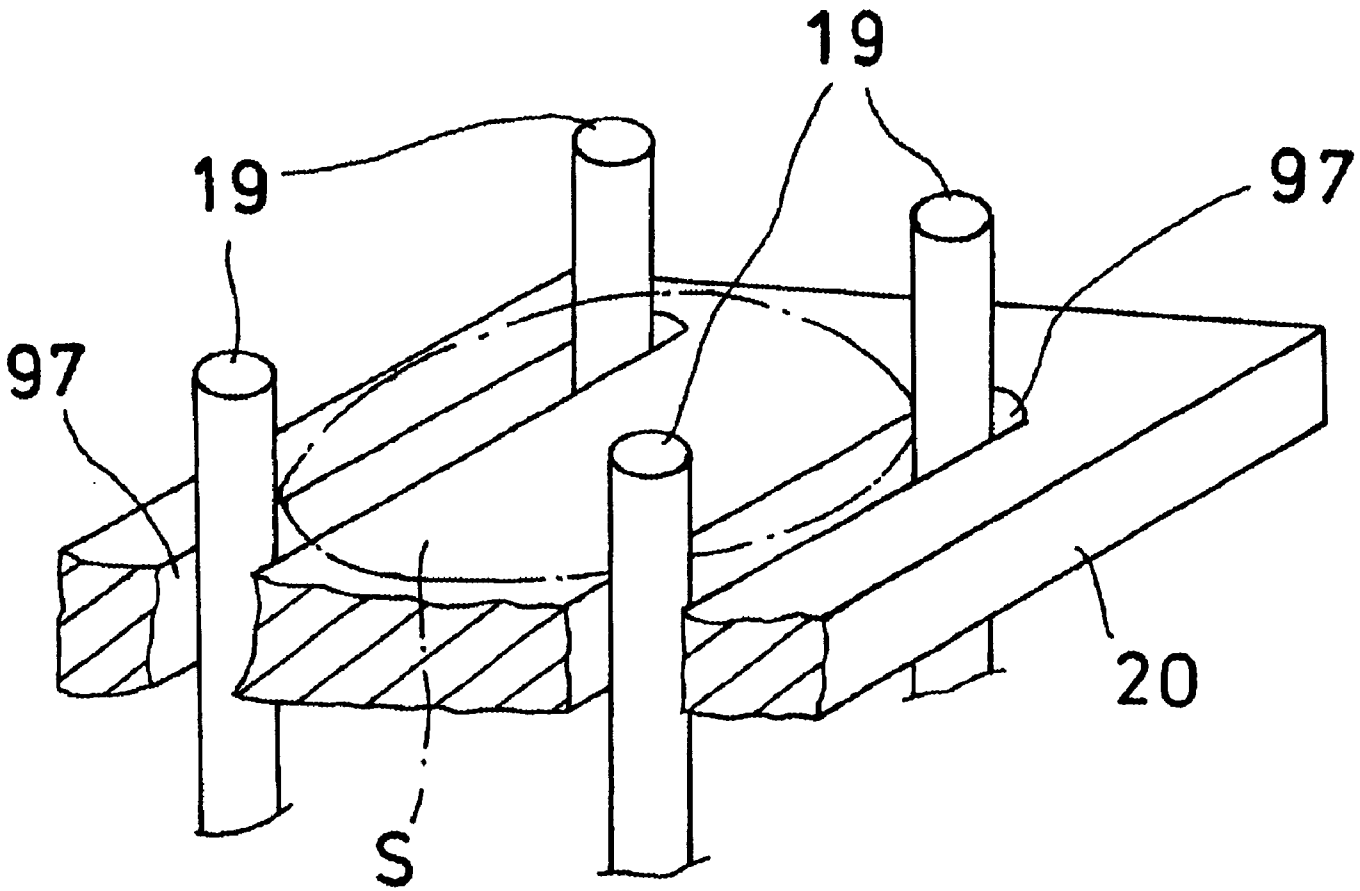
FIG. 9 is a perspective view showing another example of a casting strainer stopper.

As the casting strainer stopper, rod members 19 may be formed on the base 10 as shown in FIG. 9. And elongate holes or slots (those holes or slots are formed in a reciprocally moving direction of the slide plate 20) 97 and the rod members 19 are loosely fitted in the slots 97. In this case, the casting strainers S are placed at the inner side of the rod members 19.

If, in this embodiment, the rear end portion of the shooter 27 is turnably mounted on the slide plate 20 such that the shooter 27 is reciprocally moved on the shelf board 12 together with the slide plate 20 and if the rear end portion of the shelf board 12 is designed to have an arcuate configuration in section, the slide plate 20 is smoothly turned as it projects from the end edge portion of the shelf board 12. Accordingly, the casting strainer S can be dropped in the predetermined position smoothly.

In this embodiment, the slide plate 20 has the jump-out preventive member 29 which is allowed to project from the undersurface thereof and adapted to prevent the casting strainer S from slipping out. Accordingly, the casting strainer S placed on the shooter 27 can be prevented from slipping down when the shooter 27 moves horizontally together with the slide plate 20.

In this embodiment, the front end edge of the shooter 27 is cut into a generally V-shaped configuration. Accordingly, even if the casting strainer S has a disc-like configuration, the rear end portion of the casting strainer S is supported by at least two points when it is slippingly dropped from the shooter 27 and therefore, it can smoothly be dropped to a predetermined position (gate portion).

In this embodiment, the slide plate 20 is provided with a cooling means (cooling nozzle) 30 such that the cooling means is actuated when the slide plate 20 moves forward. Accordingly, the slide plate 20 can be cooled by the cooling means when the slide plate 20 is moved forward and stays in a standby position on the shelf board 12.

In this embodiment, the slide plate,20 is provided on its rear end with the air nozzle 26. Accordingly, dusts deposited on an object to which the casting strainers S are to be supplied can be blown off when the slide plate 20 moves backward, and dusts deposited on the shelf board 12, etc. can be blown off when the slide plate 20 moves forward.

If a distal end of the separator 22 is sharpened into a V-shaped configuration, even the casting strainers S in the form of mesh can smoothly be separated.

If a distal end of the separator 22 is sharpened into a V-shaped configuration in cross-section, the lowermost casting strainer S can easily be separated from all the remaining casting strainers S which are stacked up in superimposed relation.

Obviously, numerous modifications and variations of the present invention are possible in light of the above teachings. It is therefore to be understood that within the scope of the appended claims, the invention may be practiced otherwise than as specifically described herein.

What is claimed is:

1. An apparatus for separating casting strainers comprising:

a casting strainer receiving member formed on a base of said apparatus, said casting strainer receiving member storing a plurality of casting strainers stacked with one another;

a slide member formed on said base, said slide member horizontally sliding under the casting strainer receiving member;

a separator projecting from said slide member towards said casting strainers to separate a lowermost casting strainer from other casting strainers in the casting strainer receiving member by engaging the lowermost casting strainer at each horizontal movement of said slide member;

a casting strainer stopper formed at a lower end of said casting strainer receiving member, said casting strainer stopper restricting movements of the casting strainers other than said lowermost casting strainer when said separator contacts said lowermost casting strainer; and a casting strainer passage provided on said slide member at immediately under a projecting end of the separator, said casting strainer passage guiding the separated casting strainer therethrough in response to said horizontal movement of said slide member;

whereby separating the casting strainers stacked in the casting strainer receiving member and dropping the separated casting strainers will occur on predetermined separate locations, and wherein said lowermost casting strainer is separated from the other casting strainers toward a horizontal direction when the separator is moved to a position of the casting strainer stopper.

2. An apparatus for separating casting strainers according to claim 1, further comprising a shooter provided under the slide member to transfer the casting strainer received through the casting strainer passage to a predetermined position, wherein said shooter is disposed under said slide member such that said shooter is reciprocally movable with respect to said base in a generally horizontal posture and said shooter is forwardly downwardly turned when said shooter reaches a foremost end of a reciprocal stroke motion on said base.

3. A strainer separating apparatus for separating casting strainers and transferring each separated casting strainer to a predetermined position, comprising:

a base;

a casting strainer receiving member formed on said base of said apparatus, said casting strainer receiving member storing a plurality of casting strainers stacked with one another;

a slide member formed on said base, said slide member horizontally sliding under the casting strainer receiving member;

a separator projecting from said slide member towards said casting strainers to separate a lowermost casting strainer from other casting strainers in the casting strainer receiving member by engaging the lowermost casting strainer at each horizontal movement of said slide member;

a casting strainer stopper formed at a lower end of said casting strainer receiving member, said casting strainer stopper restricting movements of the casting strainers other than said lowermost casting strainer when said separator contacts with said lowermost casting strainer;

a casting strainer passage provided on said slide member at immediately under a projecting end of the separator, said casting strainer passage guiding the separated casting strainer therethrough in response to said horizontal movement of said slide member; and a shooter provided under the slide member, said shooter transferring the casting strainer from the casting strainer passage to the predetermined position;

wherein said lowermost casting strainer is separated from the other casting strainers toward a horizontal direction when the separator is moved to a position of the casting strainer stopper.

4. A strainer separating apparatus according to claim 3, wherein said casting strainer receiving member has a generally tubular shape with a top opening to receive the plurality of casting strainers through a casting strainer setting device, and wherein said casting strainer receiving member has a plurality of slots which are vertically extended on a tubular wall thereof.

5. A strainer separating apparatus according to claim 4, wherein said casting strainer setting device includes:

means for clamping the casting strainers by supporting the plurality of casting strainers at outer edges or bottom edges thereof;

means for controlling open and close operations of said clamping means; and an engagement piece that engages with the top-opening of said casting strainer receiving member to install the plurality of casting strainers in said casting strainer receiving member.

6. A strainer separating apparatus according to claim 5, wherein said clamping means is configured by a plurality of clamping arms each pivotally moving about a pin for said open and close operations and said controlling means is configured by a rod to control said open and close operations of said clamping arms by up-down movement thereof.

7. A strainer separating apparatus according to claim 6, wherein said clamping arms fit in said slots vertically formed on said casting strainer receiving member when said casting strainer setting device is temporarily attached to said casting strainer receiving member when installing the plurality of casting strainers in said casting strainer receiving member.

8. A strainer separating apparatus according to claim 3, wherein said slide member reciprocally moves in a back and forth manner in a horizontal direction thereby sliding under said casting strainer receiving member, and wherein said lowermost casting strainer is separated from other casting strainers at each reciprocal movement of said slide member.

9. A strainer separating apparatus according to claim 8, wherein said slide member has a slide groove on an upper surface thereof oriented in said horizontal direction and wherein said casting strainer receiving member has a projection at the lower end which engages with said slide groove thereby forming said casting strainer stopper.

10. A strainer separating apparatus according to claim 3, wherein said separator is projected from said slide member and oriented in a horizontal direction in such a way that the lowermost casting strainer contacts the projecting end of said separator thereby separating the lowermost casting strainer from other casting strainers in said casting strainer receiving member.

11. A strainer separating apparatus according to claim 3, wherein said separator is projected from said slide member in a degree that the projecting end thereof contacts with the lowermost casting strainer and wherein said projecting end of said separator is sharpened in a V-shape in cross section thereby securely separating the lowermost casting strainer from other casting strainers in said casting strainer receiving member when the projecting end contacts with said lowermost casting strainer.

12. A strainer separating apparatus according to claim 3, wherein said casting strainer stopper is formed with a plurality of projections at the lower end of said casting strainer receiving member disposed at least on a side of said casting strainer receiving member opposite to said separator.

13. A strainer separating apparatus according to claim 3, wherein said casting strainer stopper is formed with a plurality of rods upwardly projected from said slide member through slots formed on said slide member.

14. A strainer separating apparatus according to claim 3, wherein said shooter repeats reciprocal movement in the horizontal direction along with said slide member, said shooter receiving said lowermost casting strainer through said casting strainer passage at one end of said reciprocal movement when said separator contacts said lowermost casting strainer and drops said casting strainer at another end of- said reciprocal movement.

15. A strainer separating apparatus according to claim 14, wherein said shooter rotates downwardly at said another end of said reciprocal movement thereby slidably dropping said casting strainer on said predetermined position.

16. A strainer separating apparatus according to claim 15, wherein said shooter has an edge from which said casting strainer drops on said predetermined position, wherein said edge is cut into a generally V-shape in top view for supporting said casting strainer when slidably dropping from said shooter.

* * * * *